United States Patent [19]

Goldberg

[11] 4,087,090

[45] May 2, 1978

[54] AMUSEMENT DEVICE WITH VERTICAL PROJECTILE LAUNCHING AND CATCHING MEANS

[76] Inventor: Burton D. Goldberg, 15109 Watergate Rd., Silver Spring, Md. 20904

[21] Appl. No.: 684,231

[22] Filed: May 7, 1976

[51] Int. Cl.[2] ..... A63F 7/02; A63B 65/12

[52] U.S. Cl. ..... 273/95 R; 273/1 R

[58] Field of Search ..... 273/1 R, 95 R, 101

[56] References Cited

U.S. PATENT DOCUMENTS

| | | | |
|---|---|---|---|
| 1,120,518 | 9/1914 | Morgan | 273/108 |
| 1,730,726 | 10/1929 | Goerke | 273/1 R |
| 3,441,278 | 4/1969 | Edwards | 273/105 R |
| 3,638,945 | 2/1972 | Breslow | 273/1 R |

FOREIGN PATENT DOCUMENTS

| | | | |
|---|---|---|---|
| 465,740 | 9/1928 | Germany | 273/96 R |
| 24,599 of | 1905 | United Kingdom | 273/123 R |

*Primary Examiner*—Richard C. Pinkham
*Assistant Examiner*—Lawrence E. Anderson
*Attorney, Agent, or Firm*—Roylance, Abrams, Berdo & Kaul

[57] ABSTRACT

An amusement device is provided with an elongated upstanding transparent tube, closed at its top and bottom, and containing a suitable projectile, advantageously a ball. A launching means in the form of a pivotal lever is provided adjacent the bottom of the tube. Ball retaining slide members are positioned at spaced locations along the tube and are adapted to be digitally moved into and out of the interior of the tube. The ball normally rests at the bottom of the tube upon the launching lever. When the lever is depressed the ball is propelled upwardly in the tube and the user then tries to digitally insert a slide member for the purpose of catching and retaining the ball as it gravitationally drops through the tube.

4 Claims, 2 Drawing Figures

AMUSEMENT DEVICE WITH VERTICAL PROJECTILE LAUNCHING AND CATCHING MEANS

This invention relates to amusement devices and more particularly it relates to an amusement device which is capable of launching and catching a projectile, thus enabling the user to test his or her skill.

There are various forms of known amusement devices which are capable of providing both entertainment and a test of the user's skill. Such amusement devices commonly incorporate some form of moving projectile, such as a ball, which can be directed to and retained at a desired position. Examples of known amusement devices of this type include pinball machines, pachinko games, toy basketball games, and the like.

In contrast to these known forms of amusement devices, the present invention provides an amusement device which is far simpler in construction and operation, yet which provides an attractive and interesting unit which can be publicly displayed to attract interest and which can be used by young and old to provide enjoyment as well as a test of skill. The object of the present invention is to provide an amusement device incorporating these features.

The objectives of the present invention are attained by providing an amusement device which features a supporting base to which is attached an upstanding transparent tubular member, preferably a cylindrical plastic tube. The upper end of the tube is closed by a cover, thus forming an internal chamber within the tube, such chamber being closed at its upper and lower ends. A suitable projectile, advantageously a ball, is placed internally within the chamber in the tube. A projectile launching means is disposed adjacent the bottom of the tube. Such launching means advantageously takes the form of a pivotally mounted lever, a portion of which extends through a vertical slit in the tube and attaches to a ball support pad at the bottom of the tube. At vertically spaced locations along the tube, a series of ball retaining slides are provided. Each of these slides is movable through a slot in the tube between an extended and a retracted position. In the retracted position, the slide is disposed outside the tube and hence the ball can travel freely up and down the tube in response to actuation of the lever and the forces of gravity. However, if a slide member is pushed inwardly to its extended position when the ball is propelled above the level of that slide, then the ball will be caught and retained by the slide member as it gravitationally drops through the tube.

Figure 1:
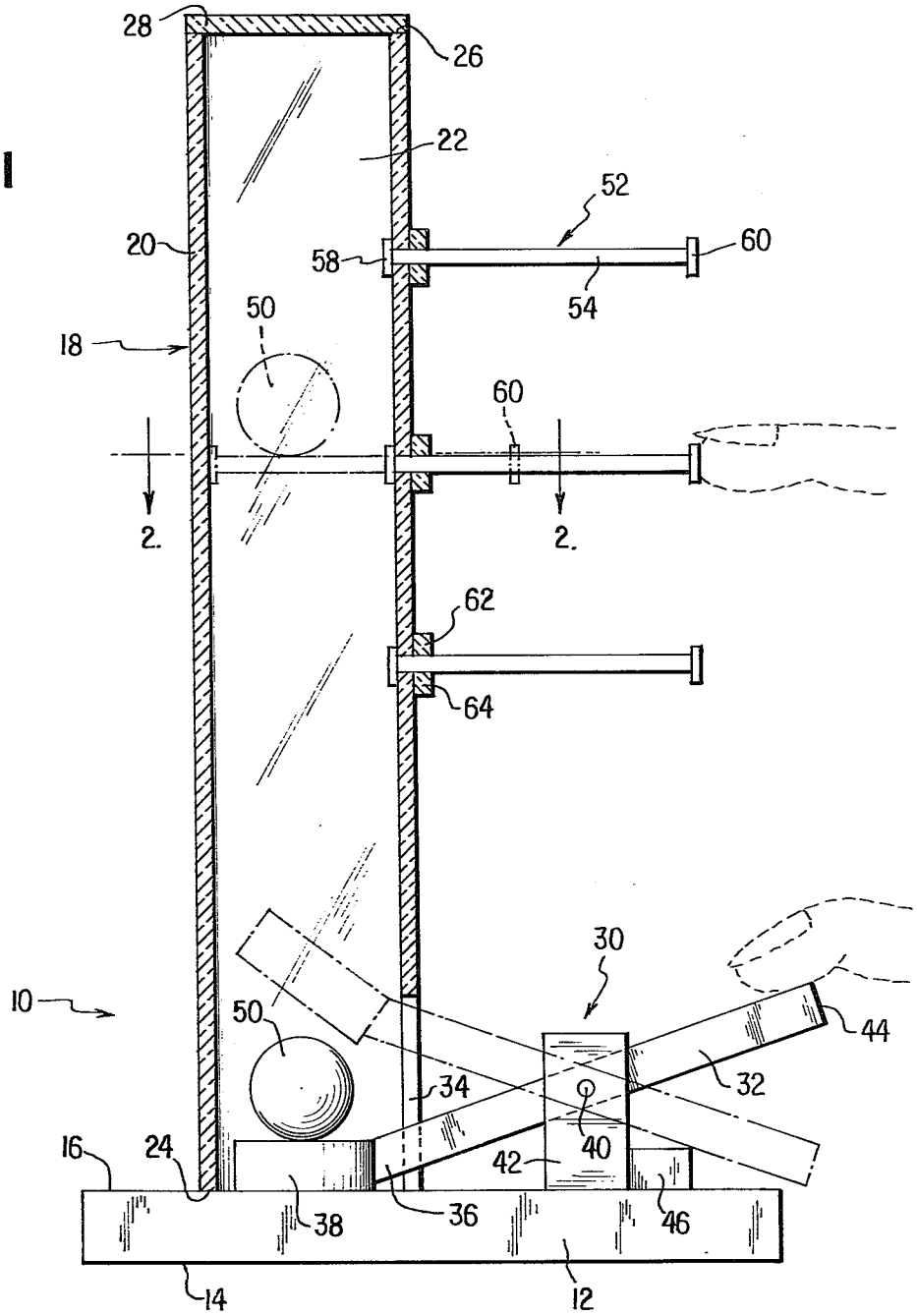
Figure 2:
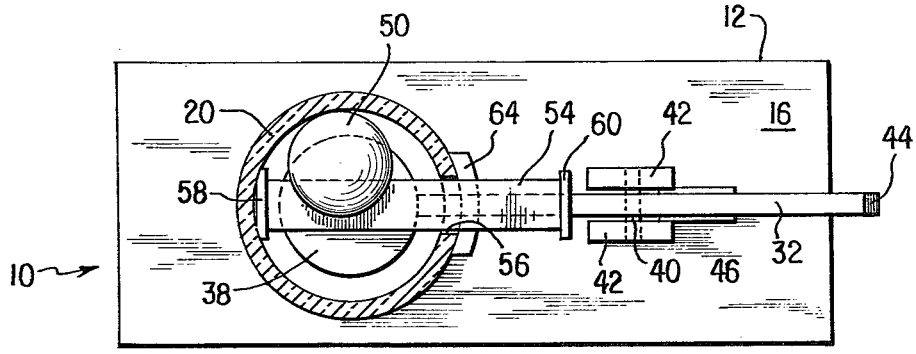

Referring now to the drawings which form a part of this original disclosure:

FIG. 1 is a side elevational view of an amusement device in accordance with the present invention, with the upstanding tubular member being illustrated in longitudinal section; and FIG. 2 is a transverse sectional view taken along the line 2—2 of FIG. 1.

Referring now to the drawings in further detail, the amusement device of the present invention is generally designated 10. It includes an enlarged base member 12 having sufficient size and weight to retain the amusement device 10 in its upright position while the device is operated. The base 12 includes a lower surface 14 which rests upon any suitable supporting surface such as a desk, table, the floor or any other similar flat surface. The base 12 also has an upper surface 16 upon which some of the remaining elements of the amusement device 10 are mounted.

The device 10 includes an axially elongated upstanding tubular member generally designated 18. Preferably, this tubular member 18 is an elongated right cylindrical tube formed by a continuous upstanding wall means 20 which circumscribes and defines an internal chamber 22. The lower end 24 of the tube is attached to the upper surface 14 of the base. The upper end 26 of the tube is closed by a cover or cap member 28. It can thus be seen that the internal chamber 22 is an elongated vertical chamber closed at its upper and lower ends and defined by the configuration of the wall means 20.

A projectile launching means generally designated 30 is provided above the upper surface 16 of the base 12. The projectile launching means 30 includes an elongated lever 32, the inner portion of which fits through a vertical slit 34 formed along the bottom of the wall means 20 along one side thereof. At the inner end 36 of the lever 32, there is provided a ball support pad 38. The lever 32 is pivotally mounted by means of a pivot pin 40 which extends between a pair of spaced upstanding support arms 42 through which the lever 32 passes. As such, the outer end 44 of the lever is normally in an elevated position, as shown in solid lines in FIG. 1. When this outer end of the lever 44 is digitally engaged, however, and subjected to a depressing movement, the lever is pivoted to its phantom line position in FIG. 1, such pivoting movement occurring until the underside of the lever 32 contacts against a stop or abutment member 46 mounted on the top surface 16 of the base member adjacent to the support arms 42.

A projectile is disposed within the chamber 22 of the tubular member 18. In the illustrated form, and in the preferred embodiment, this projectile is formed as a spherical ball 50. The ball 50 has sufficient weight so that when it is propelled upwardly within the chamber 22, it will descend under the influence of gravity and assume its normal rest position upon the ball support pad 38, as illustrated in solid lines in FIG. 1.

The amusement device 10 also includes projectile retaining means generally designated 52. Each such projectile retaining means is formed by a flat slide member 54 which preferably is movable radially with respect to the tubular member 18. That is, assuming that the tubular member 18 is a right cylinder having a central axis, then the slides 54 are movable radially of the tube member and perpendicularly with respect to its central axis.

As can be seen, in the illustrated form of invention, three slide members 54 are provided, with such slides being at vertically spaced locations along the tube. Each slide member 54 fits through a slot 56 formed in the wall means 20. An inner end member 58 is provided along the inner end of the slide 54, with the size of the end member 58 exceeding the size of the slot 56, thereby assuring that the slide member 54 cannot be pulled out from the side wall. At the opposite end of the slide member 54, an end member 60 is provided, with such end member being digitally engageable as shown in dotted lines in FIG. 1. Guide means 62, 64 are mounted on the outside of the tube, respectively above and below the slot 56 therein, such guide means serving the purpose of guiding the slide member during its movement.

In FIG. 1, all of the slide members are shown in solid lines in their retracted positions. In such retracted positions, the slide members 54 are pulled out of the tube until the inner end member 58 is engaged with the inside of the wall means 20 adjacent to the slot 56 therein. As such, the internal cavity 22 in the tube is unobstructed. When such slide members are digitally pushed inward, however, they reach an extended position as is shown in phantom lines in FIG. 1 for the middle slide member. The slide member in its extended position is likewise illustrated in FIG. 2. In this extended position, the slide traverses across the internal cavity 22 until the end portion 58 thereof contacts against the opposite side of the wall means 20. It will be noted that the length of the slide member 54 exceeds the diameter of the tubular member 18 so that even when the slide member is in its fully extended position, a portion thereof including the outer end portion 60 is spaced away from the wall means 20 and is hence readily engageable by the user's fingers to again move the slide to its retracted position.

It will also be noted, as shown in FIG. 2, that the width of the slide member 54 is correlated to the diameter of the tube member 18 and the diameter of the sphere or other projectile 50 in such a manner that the ball 50 cannot fit between the side edge of the slide member and the tube walls 20. This assures that the ball will be caught and retained by the slide member 54 when the slide is moved to its extended position.

For an understanding of the operation of the present invention, it should be realized that in its normal, rest position, the lever 32 and ball support pad 38 are in their solid line positions as shown in FIG. 1 and the ball 50 is at rest upon the support pad. To commence operation, the user depresses the outer end of the lever 44, thus pivoting the lever and causing the ball 50 to be propelled upwardly in the tube. The maximum upward movement of the ball 50 is determined by the height of the cover 28. Obviously, once the ball 50 reaches its apogee, whether it is at or somewhat beneath the cover 28, the ball 50 will thereafter start to gravitationally drop back through the chamber 22. The objective of the amusement device is to push one of the slide members 54 inwardly after the ball 50 has risen above the height of that selected slide member, but before the ball has gravitationally dropped back beneath it. If the user is successful in his efforts, he will push the slide member 54 from its retracted to its extended position before the ball drops beneath the level of that selected slide member. When this occurs, the ball will be caught and retained by that slide member, as shown in phantom lines in FIG. 1 and in solid line in FIG. 2.

Obviously, different degrees of difficulty are involved for the different slide members. That is, it would be most difficult to catch the ball by operation of the uppermost slide member because the length of time that the ball will be above the level of that member is the shortest. The easiest slide member to operate is the lowermost one since the ball will ordinarily be above this slide member for the longest period of time. It is accordingly possible to assign point values to the various slide members, as, for example, 100 points for catching the ball on the uppermost slide member, 50 points for catching the ball on the center slide member and 25 points for catching the ball on the lowermost slide member.

The degree of difficulty or ease of operation is additionally compounded by the height of the tube 18, the weight of the ball 50 and the force of operation of the launching means 30. Also, the ease or simplicity of catching the ball will depend greatly upon whether the same hand must be used for launching and catching the ball, or whether two hands can be used. This enables the amusement device to be differently adapted if it is intended to be used by adults rather than children. Thus, as an example, if the game is to be used by children, they might launch the projectile with their right hand and operate the slide member with their left hand. On the other hand, if it is to be used by adults, the rules can provide that the launching means 30 and the slide member 54 be operated by the same hand. This requires the user to first propel the ball upwardly and to then move his or her hand upwardly to push a slide member to its extended position before the ball drops beneath it. To permit this type of one-handed operation, it will be noted that the slide members 54 project out from the same side of the tube as does the launching means 30. In any operation of the device, if the user is not fast enough to push the slide member inwardly before the ball moves past the level of that slide member, the ball will simply gravitationally drop back onto the ball support pad 38 and the player will receive no points for his attempt.

Various changes and modifications apparent to those skilled in the art may be made in connection with the device described herein without departing from the spirit and scope of my invention as defined in the appended claims.

What is claimed is:

1. An amusement device for launching and catching a projectile, comprising:

an axially elongated tubular member having an upstanding wall means which circumscribes and defines an internal chamber;

said wall means being formed of transparent material to permit visual observation of said chamber;

said tubular member having an upper end and a lower end;

a supporting base connected with said tubular member at its lower end;

a cover connected with said tubular member at its upper end;

a projectile freely disposed within said chamber;

launching means at least partially disposed within the lower end of said chamber to propel said projectile axially upward in said chamber, said projectile being adapted to descend by gravitational force to come to rest upon said launching means; and projectile retaining means movably mounted in said wall means between the upper and lower ends of said tubular member;

said projectile retaining means including a plurality of retaining members which can be digitally inserted into said chamber after said projectile has been propelled upwardly above the height thereof to thereby catch and retain said projectile as it gravitationally descends in said chamber;

said wall means having a plurality of spaced openings formed therein at locations between said upper and lower ends;

one of said retaining members being disposed in each of said spaced openings and being movable between an extended position where said retaining member extends across said chamber to block passage of said projectile and a retracted position where said retaining member is substantially withdrawn from said chamber to permit free movement of said projectile;

each of said retaining members being movable independently of the other retaining members;

said retaining members being movable between their extended and retracted positions by means of digital manipulation from outside of said tubular member;

an inner end member connected to the end of each retaining member which fits within said chamber, said inner end member having a size in excess of the opening in which said retaining member is disposed to prevent said retaining member from becoming totally separated from said tubular member;

said inner end member engaging against one side of said wall means when said retaining means is moved to its extended position and engaging against the opposite side of said wall means when said retaining member is moved to its retracted position.

2. An amusement device as defined in claim 1 wherein said projectile is a ball.

3. An amusement device as defined in claim 1 wherein said launching means includes a pivotal lever having an outer end disposed outside said chamber and an inner end disposed within said chamber, and a projectile support pad attached to said lever inner end.

4. An amusement device as defined in claim 1 wherein the length of said retaining member exceeds the diameter of said chamber to assure that a portion of said retaining member will remain digitally accessible outside said tubular member even when said retaining member is completely inserted into said chamber.

* * * * *